United States Patent [19]

Jean

[11] 4,225,054

[45] Sep. 30, 1980

[54] THERMALLY INSULATED TANK FOR LAND STORAGE OF LOW TEMPERATURE LIQUIDS

[75] Inventor: Pierre Jean, Montivilliers, France

[73] Assignee: GAZ-Transport, Paris, France

[21] Appl. No.: 925,815

[22] Filed: Jul. 18, 1978

[30] Foreign Application Priority Data

Jul. 26, 1977 [FR] France ..... 77 22882

[51] Int. Cl.[3] ..... B65D 90/04

[52] U.S. Cl. ..... 220/436; 52/573; 220/439; 220/901; 220/902

[58] Field of Search ..... 220/435–439, 220/440, 901, 902; 52/573; 114/74 A

[56] References Cited

U.S. PATENT DOCUMENTS

| | | | |
|---|---|---|---|
| 2,544,538 | 3/1951 | Mahnken | 220/437 X |
| 3,149,742 | 9/1964 | Hay et al. | 220/901 X |
| 3,310,925 | 3/1967 | Brun | 52/573 |
| 3,406,858 | 10/1968 | Jackson | 220/440 |
| 3,438,430 | 4/1969 | Kestemont | 220/437 X |
| 3,547,302 | 12/1970 | Jackson et al. | 220/437 |
| 3,754,675 | 8/1973 | Richard et al. | 220/437 X |
| 4,065,019 | 12/1977 | Letouvnour et al. | 220/901 X |

*Primary Examiner*—Allan N. Shoap

*Attorney, Agent, or Firm*—Brisebois & Kruger

[57] ABSTRACT

An upright tank of cylindrical or prismatic form has a sealed inner wall surrounded by insulation, and an outer casing. The bottom of the inner wall is formed from parallel strips of INVAR welded together at inturned flanged edges and is mounted in sliding relation to insulation beneath the bottom. The inner side wall is formed from parallel vertical bands of stainless steel with inwardly bent margins welded together and slidingly supported vertically to permit expansion and contraction. The inner side wall is joined to the inner bottom wall by a corner angle assembly including sheets and angles of INVAR supported by an annular beam. The annular beam includes straight beam sections supported at their ends by gussets which in turn are anchored to the exterior casing of the tank.

15 Claims, 4 Drawing Figures

FIG.1
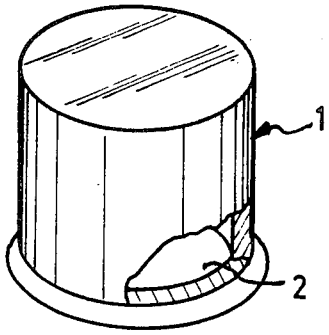
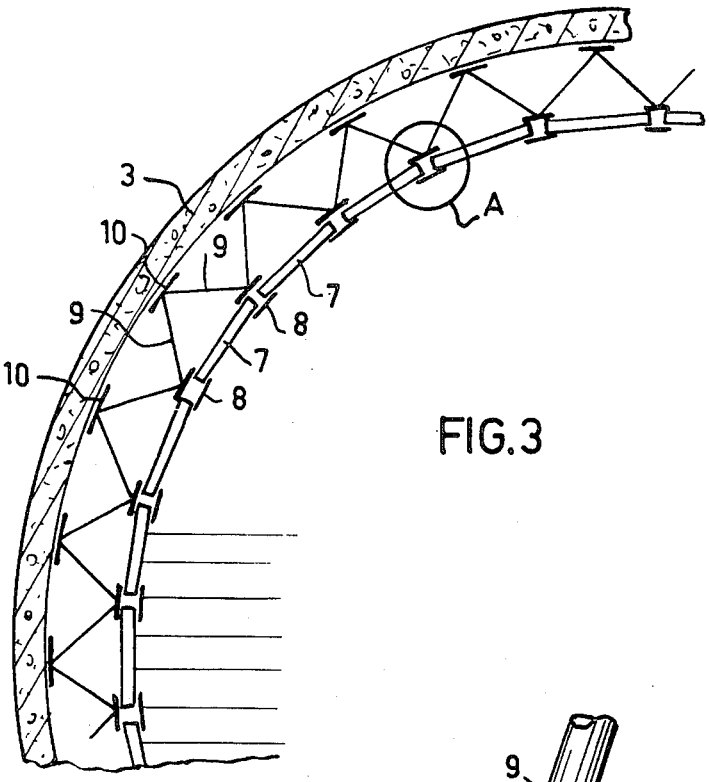
FIG.3
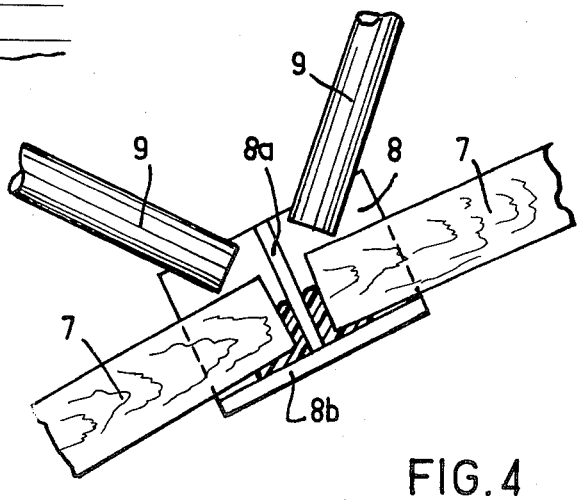
FIG.4

THERMALLY INSULATED TANK FOR LAND STORAGE OF LOW TEMPERATURE LIQUIDS

It is known that natural gas is an energy source in current use and that the transportation and storing of this natural gas is accomplished in liquefied form at a very low temperature. For the transport of this liquefied gas in ships, it has already been proposed, for example in French Pat. No. 2,146,612, to use sealed insulated tanks, comprising, two impermeable walls arranged alternately with two thermal barriers, the impermeable walls being made from thin sheets of INVAR welded, at upturned or flanged edges, the thin sheets being supported by the thermal insulation barriers. This technique is very satisfactory but is very expensive because of the high cost of INVAR.

When natural gas is stored on land, the construction of the tank can be simplified because there are no displacement movements of the liquid caused by the roll and pitch of the ship and fatigue stresses in the zones of connection of the sheets forming the impermeable walls are not present. To avoid the disadvantage of using sheets of INVAR, it has already been proposed to make spherical tanks, but this technique is not satisfactory because, first, elements to make a spherical tank are difficult to form, and second it is difficult to make supports for the spherical tank. It has already been attempted, for static storage reservoirs, to construct the tanks from thin sheets of stainless steel instead of INVAR: in such a case, the sheets which form the base of the reservoir are subjected to tractive forces and stresses which always produce ruptures which ruin the impermeability of the reservoir.

The present invention has as its purpose to provide a tank for static storing of a liquid at low temperature such as a liquefied natural gas, this tank being of cylindrical or prismatic form and having a reduced cost because, according to the invention, the impermeable barrier of the lateral surface is made with sheets of stainless steel while the impermeable barrier of the base is made of sheets of INVAR. The use of sheets of INVAR for the base avoids the excessive tensions and stresses due to contraction when the tank is cooled. All the constituent sheets of the impermeable barrier of the tank are mounted on sliding joints to permit the contractions, when the tank is cooled, the constituent sheets of the impermeable barrier on the lateral surface of the tank are free at their upper portions to be able to contract freely in a vertical direction from the fixed point which constitutes the base of the tank; in the peripheral direction, the constituent sheets of the impermeable barrier of the lateral surface of the tank can contract by the deformation of their upturned welded edges, this deformation being tolerable in the case of static storing while it is not for transport tanks in which the movements of the liquid creates stresses. This method of construction avoids the difficulties encountered in the manufacture of spherical tanks and permits cylindrical or prismatic tanks to be obtained at a reduced cost.

The present invention has, consequently, as an object, the new industrial product which constitutes a tank designed for static storing of a liquid at low temperature, particularly, a liquefied natural gas, the tank having the form of an upright cylinder or a prism resting on the ground on one of its bases, which constitutes the bottom of the tank, the wall of the tank being constituted, from the exterior toward the interior of the tank, by an exterior protective casing, with a thermal insulating barrier and an impermeable barrier formed by an assembly of welded thin metal sheets, characterized by the fact that the thin sheets of the impermeable barrier at the bottom of the tank are parallel bands or strips of INVAR welded at flanged or bent edges, the thin sheets of the impermeable barrier of the lateral surface of the tank being parallel essentially vertical strips of stainless steel welded at flanged edges, and which are free at their upper extremity and which are connected to the sheets of the bottom of the tank by a corner angle assembly in the form of a ring comprising an annular beam which is supported by the thermal insulating barrier of the tank and by multiple anchoring means regularly distributed around the periphery of the tank, all the metal strips or planks being mounted on joints slidable in relation to the thermal insulation barrier.

In a preferred embodiment, the annular beam of the element supports a corner angle assembly formed from INVAR to which is connected a vertical lining constituted by sheets welded at raised or flanged edges disposed side by side and having the same width as the stainless steel sheets of the impermeable barrier of the lateral surface of the tank, each sheet of the lining being welded in an impermeable fashion to the lower part of the impermeable barrier or wall of the lateral surface of the tank. The sheets of the vertical lining are made of INVAR or of an alloy having an intermediate coefficient of thermal expansion between that of INVAR and that of stainless steel. The corner angle assembly of INVAR is constituted by a right-angled section of INVAR joined by one of its flanges on a covering band of INVAR, which covers the upper surface of the annular beam, the other flange of the right-angled section being welded to a band of INVAR sheet, which connects by welding to the constituent sheets of the above-mentioned lining, the covering band being secured to the beam and to the extremities of the INVAR sheets forming the impermeable barrier at the bottom of the tank. The covering band is L-shaped with a leg disposed along that one of the lateral surfaces of the annular beam which is situated facing the exterior casing of the tank; the annular beam is made of sections connected by gussets between them; the sections of the annular beam are, preferably, rectilinear; all the sections of the annular beam and all the corresponding gussets are identical; the extremities of the sections of the annular beam are joined to the gussets by injection of plastic resin; each gusset is joined to the exterior casing of the tank by at least one anchoring means, no anchoring means being placed directly between the exterior casing of the tank and the sections of the annular beam; each gusset is joined to the exterior casing of the tank by two anchoring means symmetrical in relation to the plane passing through the gusset and containing the axis of the tank; the adjacent anchoring means of two closely related gussets are joined to the same anchoring plate supported by the exterior casing of the tank; the anchoring means are pipes of stainless steel; the braces being made likewise of stainless steel; the sections of the annular beam are constituted of thermally insulating material, for example of wood; the covering bands are fixed on each section of annular beam by fasteners or screws; two adjacent sheets of the impermeable barrier of the lateral surface or of the base of the tank are welded together at their flanges to a strip of the same metal interposed between the two flanges, the strip having a bent flange disposed in a groove made in a batten so it can slide freely to constitute a sliding joint, the battens being parallel, enclosed in the thermal insulation barrier and spaced by a distance equal to the width of the sheets of the impermeable barrier with which they cooperate; the battens are of wood and the groove, which is made in it, has a T-shaped section.

In practice, the realization of a tank according to the invention can be accomplished by using an exterior casing for the tank made in any known way whatever, for example, of prestressed concrete or of steel; likewise, the thermal insulation barrier can be made by means of cases filled with an insulating material or by means of a continuous layer of insulating material such as a polyurethane foam or of cork. The sections of annular beam and the battens for fastening the planks can be made of laminated wood. The stainless steel of the sheets of the impermeable barrier of the lateral surface of the tank can be an austenitic steel with 18% nickel and 8% chrome.

To better understand the invention, an embodiment will now be described, purely as an illustrative example and non-limiting, shown in the attached drawings.

In these drawings:

FIG. 1 shows a pictorial view of a cylindrical tank according to the invention designed for land storage of a liquefied natural gas;

FIG. 3 is a partial schematic view in plan of the base of the tank of FIG. 1, the insulation and impermeable barriers of the lateral surface being removed; and FIG. 4 shows the detail A of FIG. 3.

Figure 2:
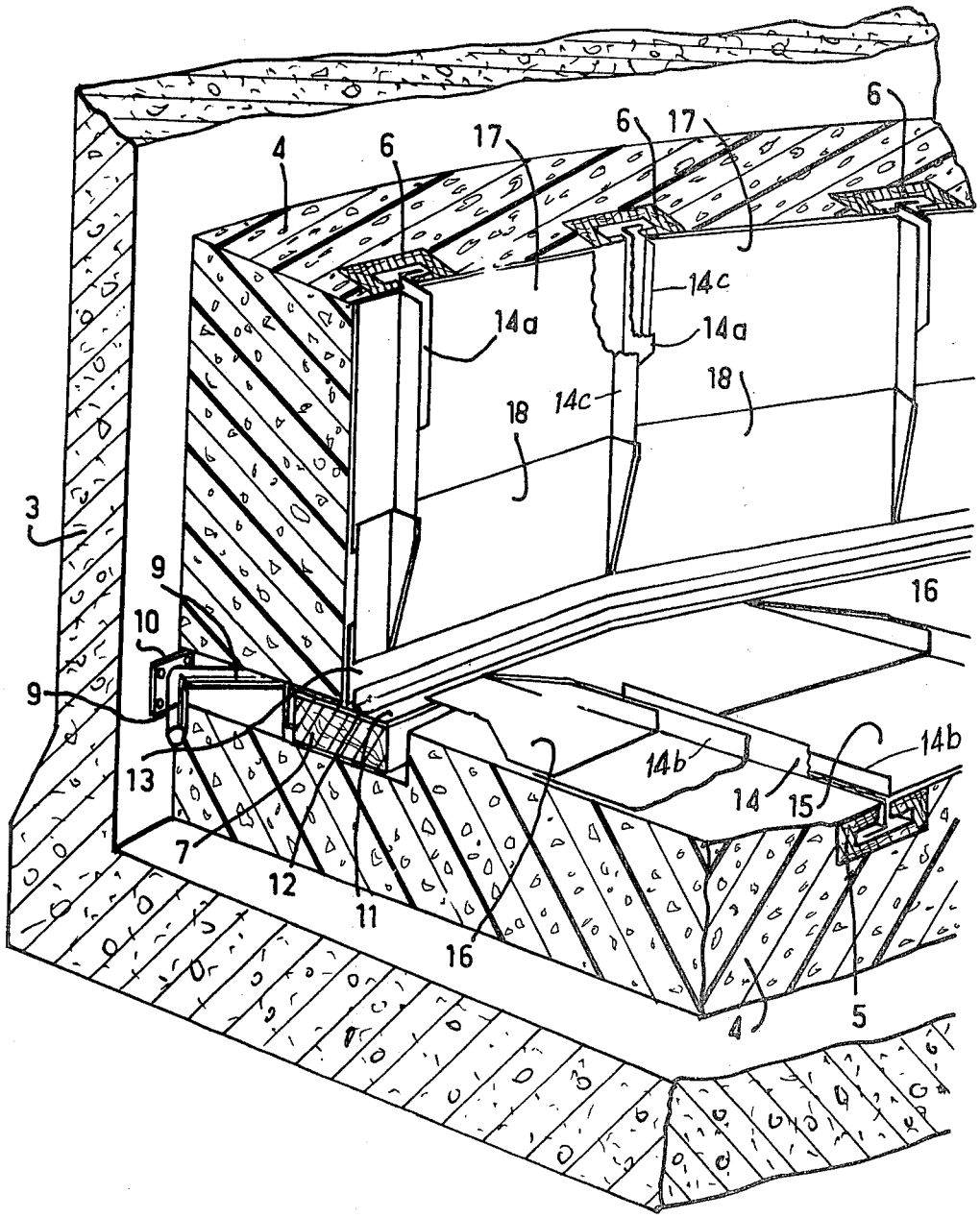
FIG. 2 is a partial enlarged view in perspective of the connection region of the bottom and the lateral surface of the tank of FIG. 1.

Referring to the drawings, it can be seen that a cylindrical tank intended for land storing of a liquefied natural gas has been designated by 1 in its entirety. Tank 1 is an upright cylinder of revolution resting on the ground on one of its ends which constitutes the bottom of the tank. In a known manner, the upper part of the tank is surmounted by a thermally insulating lid-structure or cover, which is not shown in the drawings and which is not part of the invention.

Tank 1 comprises an exterior casing 3 of prestressed concrete. Casing 3 is covered on its inside by a thermal insulation barrier 4 of polyurethane foam, which covers the entire bottom and the inner lateral surface of the tank. In the insulation barrier 4 of the bottom of the tank, battens 5 are placed which are all parallel to each other and one of the diameters of the base. The axes of battens 5 are separated from each other by 50 cm. In the thermal insulation barrier 4 of the lateral surface of the tank, battens 6 are placed which are identical to battens 5 and are placed parallel to the generatrices of the cylinder which constitutes the tank, the axes of two adjacent battens 6 being separated by 50 cm. Battens 5 and 6 are made of laminated wood and have along their entire length a milled groove whose section is T-shaped (as shown at FIG. 2) the stem of the T opening to the exterior of the batten and the thermal insulation barrier 4. The battens 5 and 6 are level with the interior surface of barrier 4.

The thickness of barrier 4 on the bottom of the tank is constant over the entire central zone of the base but is diminished over a peripheral ring area to create at the periphery of the base, at right angles with the thermal insulation barrier of the lateral wall, an annular groove to permit installing an annular beam and anchoring means for the beam. The annular beam, which surrounds the thicker inner region of barrier 4 of the bottom of the tank, is an assembly of multiple rectilinear sections 7 which are 1 meter in length, opposite ends of each section seating on a gusset 8. The sections of beam 7 are made of laminated wood. Each gusset 8 supports the extremities of two adjacent sections 7 on opposite sides of a central web **8*a*. Gusset 8 is constituted of a rectangular base plate of stainless steel supporting a web 8*a* separating the plate in two equal parts and a web 8*b* perpendicular to web 8*a* along the edge of the plate which is closest to the center of the tank. The webs are welded to the plate and are of stainless steel. The extremities of the two sections 7, which cooperate with the same gusset 8, are positioned on both sides of web 8*a* in the corner formed by webs 8*a* and 8*b*. The fastening of sections 7 on gusset 8** is accomplished by injection of epoxy resin.

Each gusset 8 is joined to the exterior casing 3 of the tank by two pipes or tubes 9 each welded onto the gusset, the two pipes being positioned symmetrically in relation to web **8*a* and forming with it an angle of 45°. Two pipes 9 of two adjacent gussets 8 join with each other, at the exterior casing 3, on the same anchoring plate 10, which is bolted to the exterior casing 3. The annular space, through which pipes 9** extend is filled with thermal insulation after placement of the anchoring means.

Each section 7 of the annular beam is associated with a right angle corner assembly which is secured to section 7 before placing this section between two adjacent gussets 8. The above-mentioned corner assembly includes a covering band 11 made from a sheet of INVAR with a rear side bent at a right angle and extending downwardly and bordering the side surface of section 7 which faces exterior casing 3. The covering band is secured to section 7 by nailing of the rear side and the area of band which is covered by the connecting sheets 16 which will be described later. To this covering band 11 is welded a right-angled section 12 also made of INVAR, the upright leg of which is welded to a connecting band 13 constituted by a sheet of INVAR. The corner assembly associated with section 7 is thus constituted by the assembly (11, 12, 13) and a connecting piece is provided at each bracket 8 and is welded between two adjacent corner assemblies.

An intermediate strip 14 of INVAR is positioned in the groove of each batten 5. Strip 14 has an L-shaped section, one of the flanges of the L being inserted in the T-shaped groove of batten 5 as can be seen in FIG. 2. Between two adjacent intermediate strips 14, are strakes or planks 15 of INVAR constituted by continuous bands of sheets with upwardly bent flanges or sides **14*b*, the flanges 14*b* engaging against intermediate strips 14. Two adjacent planks 15 are welded at their edges on each side of the intermediate strip 14 to provide a sealed wall or impermeable barrier at the bottom of the tank. The planks 15, for convenience, are terminated at a certain distance from the annular beam and an INVAR junction sheet 16 with side flanges effects the connection between the terminated ends of the planks 15 and the nearest portion of the covering band 11, this connection being sealed by welding. Thus one secures planks 15 of the impermeable barrier of the bottom of the tank to the annular beam constituted by the sections 7 secured by their covering bands 11**.

In the grooves of battens 6, one places strips **14*a* having a shape identical to strips 14, but made of stainless steel; strips 14*a* are positioned in the grooves of battens 6 like strips 14 are in the grooves of battens 5. Between two adjacent strips 14a, one positions a plank 17 of stainless steel made of a band of sheet metal with upturned side flanges 14c which engage against two adjacent intervening strips 14a. One welds the edges of the flanges 14c of planks 17 on both sides of intervening strips 14a and one thus makes the impermeable barrier or sealed side wall of the lateral surface of the tank. Bands 13 of the corner angle assembly of the annular beam are connected to the lower margins of the planks 17 by a connecting lining of INVAR sheets 18 with side flanges. The lining sheets 18 are welded together on planks 17, on bands 13, and along the edges of their upturned flanges. It is thus evident that angle corner assembly (11, 12, 13), junction sheets 16, and lining sheets 18**, provide a sealed or impermeable junction between the impermeable bottom wall of the tank, made of INVAR and the impermeable side wall of the tank made of stainless steel. All the elements which have been mentioned above as having been made of stainless steel are made of austenitic steel with 18% nickel and 8% chrome.

It is advisable to point out that planks 15 are restrained at their two extremities by the connection with sections 7 of the annular beam in such a way that their contraction is not free, but this is not troublesome since they are made of INVAR and the coefficient of expansion of INVAR is small; nevertheless, the contraction of planks 15 is accomplished by sliding joints through the cooperation of strips 14 and battens 5. It should be noted concerning planks 17, that they likewise are mounted on sliding joints through the cooperation of strips 14a and battens 6, but are free to contract vertically since their upper extremity is not joined to any fixed element; planks 17 can thus contract and, at the time of cooling, their upper extremities draw nearer to the base of the tank. In the periperal direction, the contraction of planks 17 results in a deformation of the welded zones at the edges of the flanges, the flanges of the planks separating slightly from the intervening strips 14a used for welding, which is permissible since static storing is involved.

It is appropriate to note that the anchoring means interposed between the annular beam and the exterior casing of the tank permits the incasing of forces due to the contraction of the sheets of the impermeable barrier of the bottom of the tank whatever may be the point of the periphery, and even though the planks of the bottom are all parallel to one of the diameters of the base, which constitutes a privileged direction. Thus one avoids, by associating with each brace 8 two pipes 9, the greatest flexture or bending forces, which would occur if a brace was only joined to the exterior casing by a single anchoring member.

It can be verified that the embodiment, which has just been described, permits the construction of tanks for land storing of liquefied natural gas, in a much more economical way than the present state of the art would permit, while maintaining the same conditions of security.

It is of course understood that the above described embodiment is in no way limiting and would be able to have any desirable modifications, without going beyond the scope of the invention.

What is claimed is:

1. A tank for static storage of a liquid at low temperature, said tank comprising an upright side wall and a bottom, said side wall comprising an exterior casing, an internal wall forming an impermeable barrier, and thermal insulation between said casing and said internal wall, said bottom of the tank comprising a horizontal bottom wall forming an impermeable barrier at the bottom of the tank, and thermal insulation beneath the bottom wall, said internal wall comprising a plurality of parallel bands of thin stainless steel, said bands extending vertically and each having side flanges, and welds along said flanges to seal said internal wall, said bottom wall comprising a plurality of parallel bands of thin metal having a very low coefficient of thermal expansion, said bands of said bottom wall each having side flanges, said side flanges being welded to seal said bottom wall, a corner structure connecting said side wall to said bottom wall in sealed relation and comprising, an annular beam supported by thermal inlation and comprising a plurality of rigid beam sections, adjacent facing ends of adjacent beam sections being secured together by a common gusset so that each end of a beam section is attached to a gusset, each beam section having attached thereto an L-shaped angle assembly of a material of low thermal expansion and presenting a vertical leg and a horizontal leg, and a vertical lining strip comprised of flanged sheets in side by side relation and of the same width respectively, as the stainless steel bands of said inner wall, said flanged lining sheets extending generally vertically between said angle assembly and said inner wall, being welded along their edges, and being welded to said vertical leg of said angle assembly and to said stainless steel bands of said side wall, means for securing each gusset to said outer casing with anchoring elements arranged symmetrically with respect to a radial plane of the tank at regularly spaced intervals around the periphery of the tank, adjacent anchoring elements of two adjacent gussets located at each end of a beam section being secured to a common anchor plate secured to the external casing of the tank, and means mounting said side wall and said bottom wall on sliding joints for sliding movement with respect to said thermal insulation.

2. A tank according to claim 1 wherein said vertical lining strip comprises a vertical lining of INVAR.

3. A tank according to claim 1 wherein said vertical lining strip comprises a vertical lining of an alloy having a coefficient of thermal expansion between that of INVAR and stainless steel.

4. A tank according to claim 1 wherein said angle assembly comprises a cover band of INVAR covering an upper face of said annular beam and a corner angle having one of its legs welded to said cover band and its other leg welded to a peripheral band of sheets of INVAR, said peripheral band being joined by welding to said lining strip, said cover band being secured to the annular beam.

5. A tank according to claim 4 wherein said cover band includes a downwardly bent angle leg extending along an outer side surface of said annular beam.

6. A tank according to claim 5 wherein said annular beam comprises sections of a thermally insulating material.

7. A tank according to claim 6 wherein said annular beam sections are comprised of wood.

8. A tank according to claim 4 wherein said cover bands are secured to said beam sections by fasteners.

9. A tank according to claim 1 wherein said beam sections comprise rectilinear beams.

10. A tank according to claim 9 wherein all said beam sections and all said gussets are identical.

11. A tank according to claim 1 wherein ends of said beam sections are secured to said gussets by a plastic resin.

12. A tank according to claim 1 wherein said annular beam is devoid of a direct connection between its sections and said exterior casing.

13. A tank according to claim 12 wherein each anchoring element comprises a stainless steel tube, and said gussets comprise gussets of stainless steel.

14. A tank according to claim 1 wherein said means mounting said inner side wall on joints for sliding movement comprises an intermediary strip between the flanges of adjacent vertical bands, said flanges being welded at their edges to said vertical strip, said intermediary strips each having a bent leg disposed in grooves of battens parallel with and outside said inner side wall, said battens being surrounded by insulation and spaced apart a distance equal to the width of the bands of said inner side wall.

15. A tank according to claim 14 wherein said battens each comprise battens of wood, and said groove in each batten comprises a T-shaped groove.

* * * * *